US006802346B1

(12) United States Patent
Meinander

(10) Patent No.: US 6,802,346 B1
(45) Date of Patent: Oct. 12, 2004

(54) PROCESS AND AN ARRANGEMENT AT SUCTION ELEMENT

(75) Inventor: Paul Olof Meinander, Grankulla (FI)

(73) Assignee: Pom Technology Oy AB, Helsingfors (FI)

( * ) Notice: Subject to any disclaimer, the term of this patent is extended or adjusted under 35 U.S.C. 154(b) by 0 days.

(21) Appl. No.: 10/258,134

(22) PCT Filed: Apr. 12, 2001

(86) PCT No.: PCT/FI01/00365

§ 371 (c)(1),
(2), (4) Date: Jan. 28, 2003

(87) PCT Pub. No.: WO01/81676

PCT Pub. Date: Nov. 1, 2001

(30) Foreign Application Priority Data

Apr. 19, 2000 (FI) ..... 20000938

(51) Int. Cl.[7] ..... B65B 1/04
(52) U.S. Cl. ..... 141/86; 162/190
(58) Field of Search ..... 162/190, 189, 162/264, 335, 337; 141/86, 311 A

(56) References Cited

U.S. PATENT DOCUMENTS 3,865,687 A * 2/1975 Rajala ..... 162/343

5,567,278 A 10/1996 Meinander

* cited by examiner

*Primary Examiner*—Steven O. Douglas
(74) *Attorney, Agent, or Firm*—Browdy and Neimark, P.L.L.C.

(57) ABSTRACT

The invention relates to a process for collecting process water at a paper machine or the like, wherein water from several suction elements (2 . . . 2*n*, 2*m*) provided at a wire (1) is led in such a way that an unbroken liquid column is maintained in the outlet pipes (8 . . . 8*n*, 8*m*) of the suction elements and is made to join a common collecting vessel (9, 9*m*). The liquid levels (20 . . . 20*n*) of the outlet pipes am regulated by regulating the liquid level (11) in at least one separate level vessel (10) towards which the water from the respective outlet pipes is led in at least one closed and essentially horizontal collecting channel (9, 9*m*) which is common for several outlet pipes. (8 . . . 8*n*, 8*m*), the liquid in said collecting channel (9, 9*m*) at the same time forming the lower part of said unbroken liquid column. The invention also relates to an arrangement for collecting process water, wherein the collecting vessel is composed of at least one essentially closed collecting channel (9, 9*m*) to which outlet pipes connect below the liquid level.

15 Claims, 3 Drawing Sheets

Figure 1:
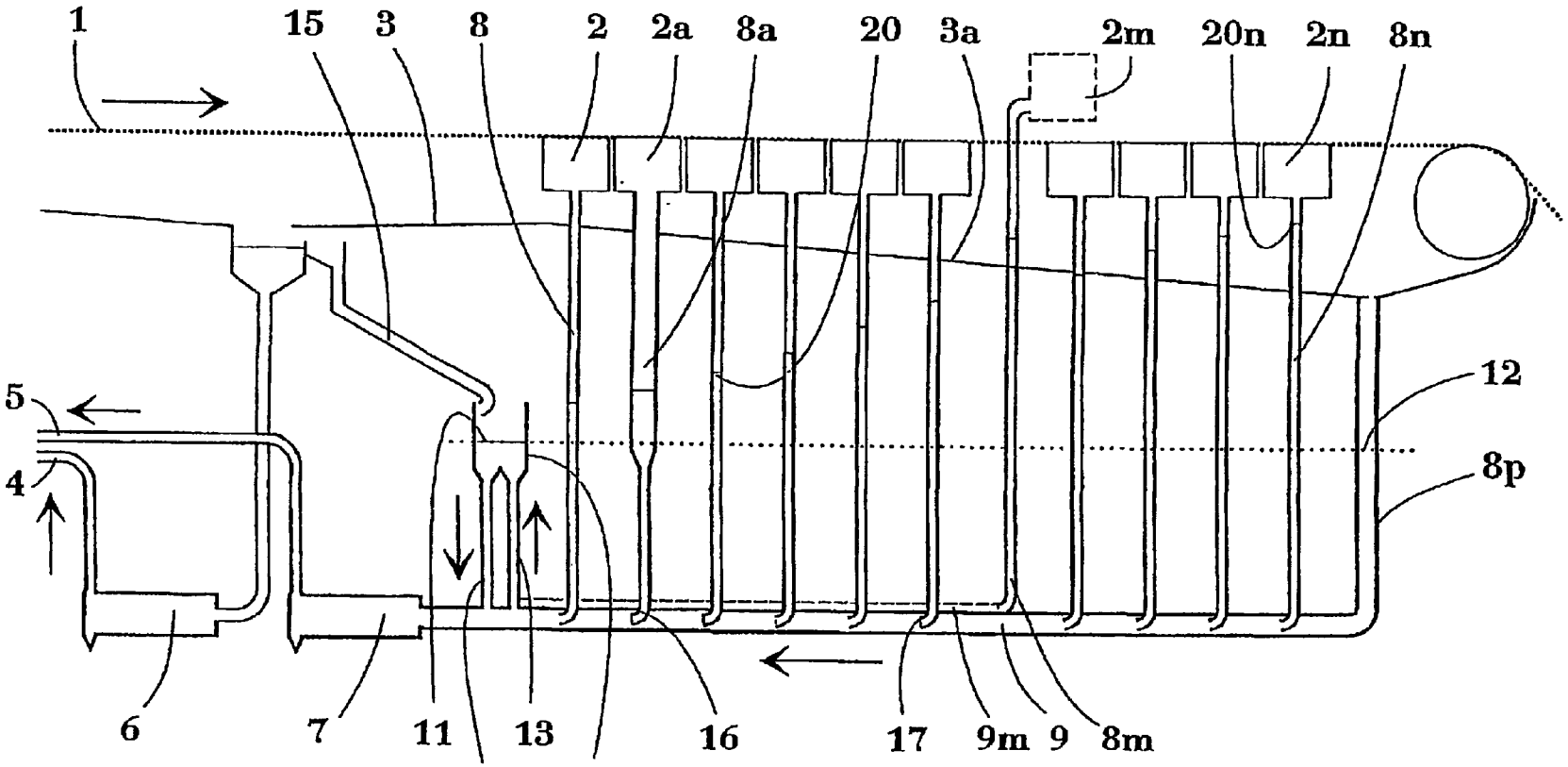

Fig 5a
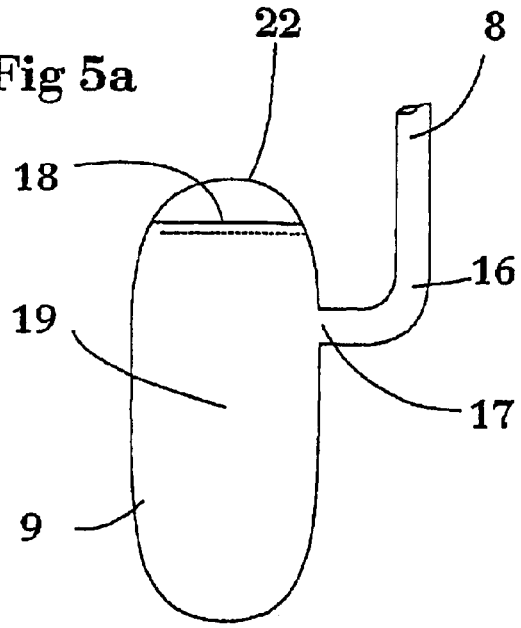
Fig 5b
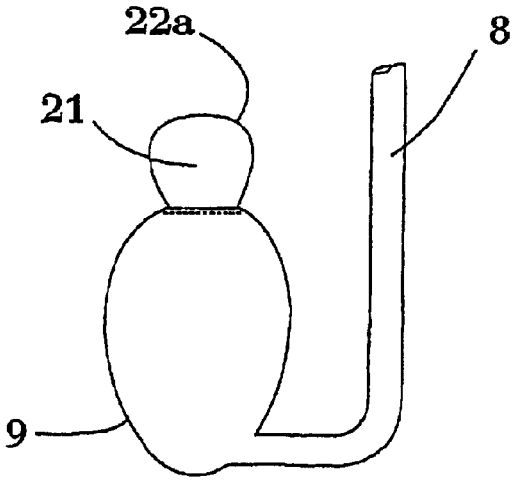
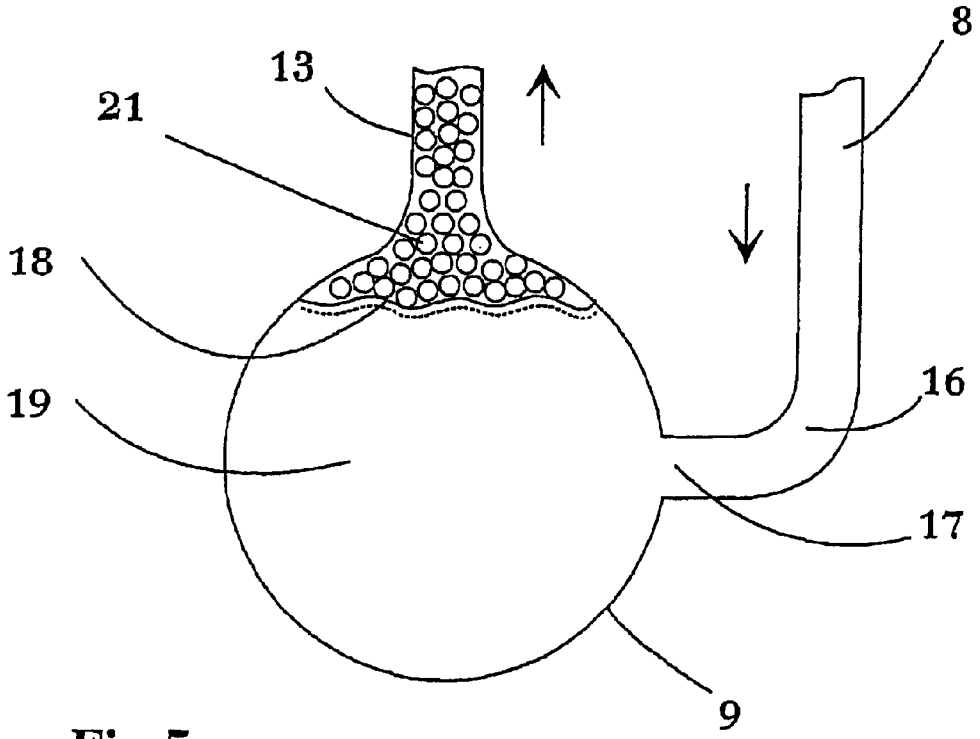
Fig 5c

PROCESS AND AN ARRANGEMENT AT SUCTION ELEMENT

The present invention relates to a process for collecting process water at a paper machine or the like, wherein water from several suction elements provided at the wire is led in such a way that an essentially unbroken liquid column is maintained in the respective outlet pipes of the respective suction elements and said liquid column is made to join common collecting vessels. The invention also relates to an arrangement for collecting process water at a paper machine or the like, said arrangement comprising suction elements provided under the wire section said suction elements being connected by essentially vertical outlet pipes to at least one collecting vessel.

In the case of prior known papermachines and the like machines having suction elements in the form of suction boxes, the outlet pipes from said elements are generally connected to an essentially open collecting vat, which at the same time often functions as a deaerating means for the air contained in the water. The process water is generally at least partially returned from this collecting vat for joining a suitable phase in the initial part of the process in order to re-use a part of the material and the energy remaining in this water and also in order to reduce the amount of effluents from the process.

Since this so called long system should be able to balance the process both at start-up and during normal operation as well as in case of any operational disturbances, the system normally comprises huge amounts of liquid, which, on the other hand, results in a slow circulation and a process with a tendency to contamination, Since this long system extends over a large portion of the machine, it generally includes many long extensions with inclined or horizontal pipes. Practice has shown that these pipes often create problems since the air which always remains in the water easily forms air pockets which, in turn, results in an instable process with disturbances in pumps and other equipment. The air also causes unwanted foaming which is deposited on free surfaces in tanks and pipes and creates additional disturbances. In order to alleviate these problems, the system generally includes special deaerating means for removing as much air as possible from the water in order to enable pumping to different parts of the machine. In practice it is, however, difficult to make these deaerating means sufficiently effective without at the same time creating disturbances in the actual liquid flow. Therefore, a significant amount of unwanted air will in practice always be present in the process water.

Since the long system comprises said huge volumes and long pipe lines, it is in practice also difficult to maintain uniform flow conditions at all points. Stagnant water is thus a common problem and it results in accumulations of dirt in dead angles of the system. This dirt contributes to disturbances by occasionally breaking loose and by following the liquid flow in the form of accumulations which then choke up pumps and valves and which cause quality problems in the actual product.

In order to maintain the function in the suction elements it is important that the liquid column in the barometric outlet pipes of the suction boxes is kept unbroken. In the prior art this has been solved by connecting the pipes to one or more substantially open lock water tanks from which the water is pumped to the process. In practice the tanks have to be big since the pumps need a certain inlet pressure in order to function satisfactorily. At the same time the huge volumes cause problems with contamination and they also complicate quick changes in the production, such as changes in quality and the like. Since the pipe lines in practice include long extensions, it is also difficult to avoid the formation of air pockets which interrupt the vacuum and cause operational problems. The voluminous systems in themselves also cause troubles since it is not always easy to find suitable places for the space consuming systems.

The object of the present invention is to provide a solution to these problems and to provide an arrangement with a small liquid volume, little contamination risks and a minimal part of free liquid surfaces. At the same time the object is to provide an effective deaeration and a reduction in the drawbacks which are caused by an unwanted foaming. The arrangement should also offer simple and effective means for controlling the process.

Said objects are provided according to the invention in the way disclosed in the appended claims. Thus, the process according to the invention is characterized in that the liquid levels of the outlet pipes are regulated by regulating the liquid level in at least one separate level vessel towards which the water from the respective outlet pipes is led in at least one closed and essentially horizontal collecting channel which is common for several outlet pipes in such a way that the liquid in said collecting channel at the same time forms the lower part of said unbroken liquid column. The arrangement according to the invention is characterized in that the collecting vessel is composed of at least one essentially closed and generally horizontal collecting channel to which said outlet pipes connect below the channel liquid level.

Figure 2:
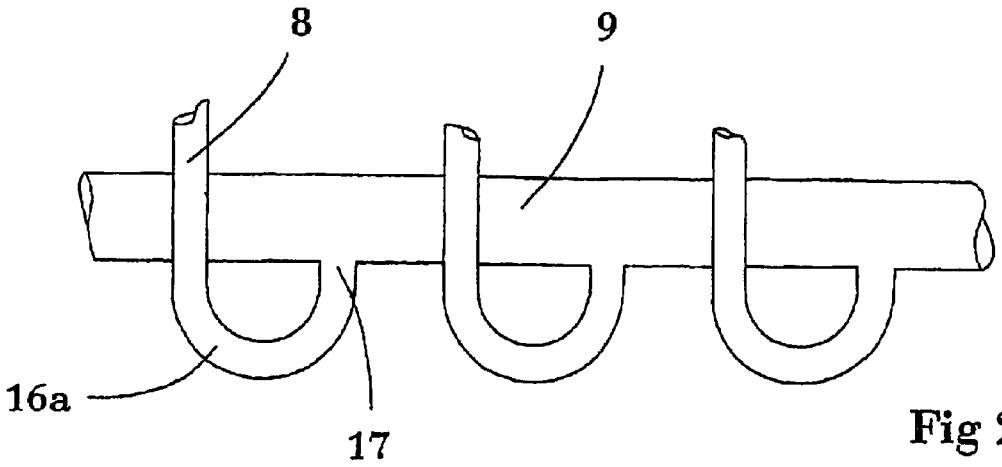
Figure 3:
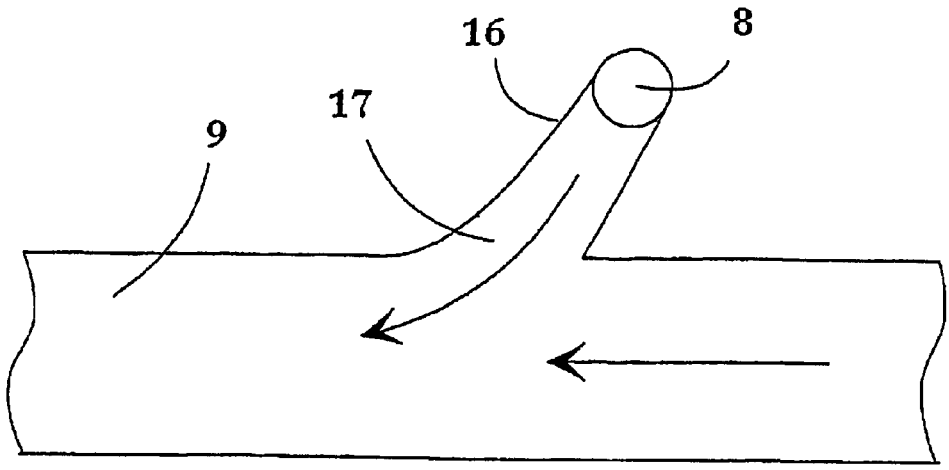
Figure 4:
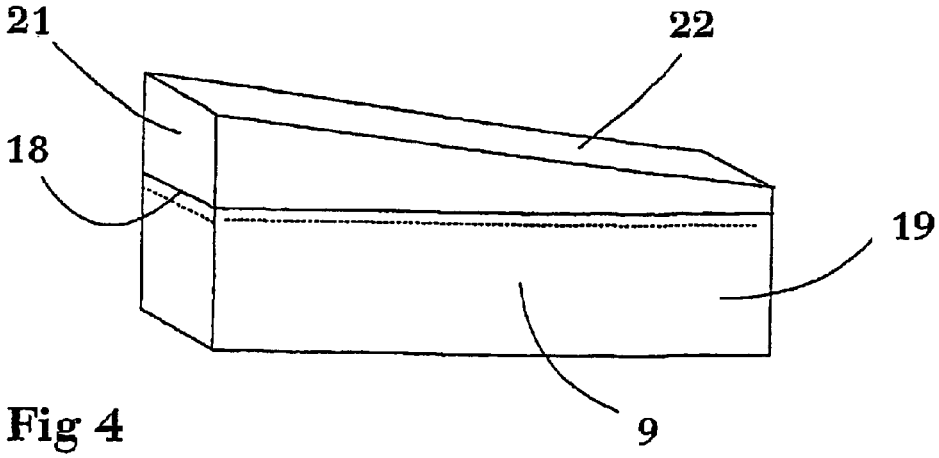

A preferred embodiment of the invention is generally described below as an example with reference to the appended drawings, wherein FIG. 1 discloses a general view of an arrangement according to an embodiment of the invention, FIG. 2 discloses an alternative embodiment of the connection between the outlet pipes and the horizontal collecting channel according to the invention, FIG. 3 discloses a preferred connection of a barometric pipe from a suction box to the collecting pipe, FIG. 4 shows a greatly exaggerated section of a collecting channel such that the bottom of the channel is arranged to be essentially horizontal while its top portion is arranged to be inclined, whereby the height of the channel increases in the direction towards the level vessel, and FIGS. 5*a* to 5*c* disclose different alternative cross sections of the collecting channel according to the invention.

The arrangement according to FIG. 1 generally comprises a paper machine or the like machine wherein a material web 1 running in the direction of the arrow is arranged in a way known per se so that liquid from the web is separately sucked out by suction elements provided in the form of suction boxes 2, 2*a* . . . 2*n* or the like elements. A back water tray or save-all tray 3, 3*a* for collecting water which is not sucked out by the suction boxes 2 is arranged under the wire. The save-all tray is generally divided so that a portion 3, which lies early in the process direction, leads the process water to the so called short system or circulation 4 while a portion 3*a*, which lies later in the process direction, leads the process water towards the so called long system 5. In the illustrated preferred embodiment the pumping of these process water portions is performed with degassing pumps 6, 7 which are described in greater detail e.g. in U.S. Pat. No. 5,861,052.

In order to maintain a suitable vacuum and an appropriate dewatering in the suction boxes 2, 2*a* . . . 2*n*, which are suitably arranged successively along the material web 1, the outlet pipes 8 . . . 8*n* of the suction boxes are provided in the form of so called barometric pipes whose upper parts are connected to the suction boxes in a way known per se. According to the invention, the lower parts 16 of the respective outlet pipes 8 . . . 8*n* are connected to a common collecting channel 9 via special elements so that the connection 17 lies under the surface 18 of the liquid 19 in the channel 9, as is more clearly shown e.g. in FIG. 5*a*.

In the embodiment shown in FIG. 1 the collecting channel 9 is disclosed as one single channel, but in practice the channel may also be divided into several separate channels arranged in parallel and/or successively. Parallel channels 9, 9*m* may further be arranged so that each respective channel collects only or mainly liquid of a certain consistency or of a certain origin for further treatment in accordance with the special requirements of that specific liquid fraction. Parallel channels 9, 9*m* may further be used e.g. in case of successive modifications of prior existing plants which have another kind of collecting system, as well as for transporting water e.g. from the suction box 2*m* of a top wire, either in combination with water from elsewhere or separately. In FIG. 1 such an arrangement is schematically indicated by a partly broken line with the reference numerals 8*m* and 9*m*, respectively.

FIG. 1 shows with level indications 20, 20*n* how the vacuum in the respective suction boxes 2, 2*a* . . . 2*n*, 2 is arranged. Thus, the vacuum increases in the process direction as the web 1 becomes drier and releases less water. Water and air which is sucked into the suction boxes 2, 2*a* . . . 2*n* flows down along the barometric pipes and 8 . . . 8*n* and is led into a common liquid stream 19 in the substantially horizontal collecting channel 9. A certain segregation takes place therein so that the water flows along the bottom of the channel while air and foam 21 accumulate at the top 22 of the channel 9. The movement in the horizontal collecting channel 9 is primarily maintained with the aid of the pump 7. According to a preferred embodiment, a part of the movement is caused by the air enclosed in the water owing to the fact that the collecting channel 9 or especially its top portion 22 as such is arranged to rise slightly in the direction of the pump 9, which is shown with exaggeration in FIG. 4. According to an embodiment which is shown, for instance, in FIG. 5*b*, the top portion is further designed as a special channel 22*a* for the foam.

According to the invention, the collecting channel 9 is connected to a level vessel 10 having a free surface 11. Said level vessel 10 is used, on one hand, for controlling the actual process by enabling variation of the level of the liquid surface 11, which is shown by a broken line in FIG. 1. This general level exists in the shown embodiment also at the free liquid surface 12 at the opposite end of the collecting channel which is suitably connected to the back portion 3a of the save-all tray. On the other hand, the same level vessel 10 is preferably used also as a foam separator, as disclosed in greater detail below.

At start-up of the system according to the invention care is taken to ascertain that the water level in the level vessel 10 reaches up to a sufficient height. This will automatically ensure that substantially the same water level is provided during the start-up also in the collecting pipes 8 . . . 8*n*, which automatically prevents the collecting pipes from being emptied by the suction caused by the vacuum applied to the suction boxes.

When water and foam flow in the collecting channel 9, at least the foam 21 will suitably first encounter an inlet channel 13 to the level vessel 10. At this inlet the foam 21 and most of the air rises upwards to the surface 11 of the level vessel, from where the foam is removed in a suitable way. The direction of movement in the inlet channel 13 is indicated by an upwards directed arrow. The energy for this movement is suitably provided by the air contained in the water. Having reached the surface 11, the water is suitably led back to the collecting channel 9 via an outlet channel 14 which is located closer to the inlet of the pump 7. This results in a continuous liquid movement which is primarily caused by the difference in specific weight between the foaming liquid and the liquid from which the foam 21 has been removed. In addition to the water which derives from the collecting channel it is also suitable to direct process water from elsewhere, in the shown case e.g. water from the short system via an overflow 15, to the level vessel 10, suitably to a point above its highest surface 11. In order to prevent stagnation in the level vessel an embodiment of the invention comprises introducing such water tangentially at the wall of the level vessel 10, whereby a certain rotation is maintained in the vessel 10.

The collecting channel 9 is preferably construed as a continuous, even, suitably slightly rising, and substantially horizontal channel. There should not be any pockets or other points where foam 21 and dirt may accumulate. At the same time, the total liquid volume in the collecting pipe 9 is much smaller than in conventional arrangements. This provides a large flexibility for instance for quick quality changes. The arrangement also results in a radically reduced sensitivity to disturbances in the whole system.

As shown especially in FIGS. 5*a* to 5*c*, the outlet pipes 8 . . . 8*n* are connected to the collecting channel 9 in such a way that the orifices 17 of the pipes are all the time below the liquid surface 18 in the channel 9. FIG. 1 shows generally an especially preferred embodiment wherein the pipes 8 are connected directly to the side of the channel. In another embodiment, which is shown in FIG. 2, the pipes 8 . . . 8*n* are attached to the channel in such a way that they connect to the bottom of the channel 9 via a bend 16*a*. This arrangement actually provides a guarantee against a collapse of the liquid column in the pipe 8 as a result of a too low liquid level in the collecting channel 9. However, the bends 16*a* must be very carefully designed in order to prevent accumulation of contaminants. The embodiments of FIGS. 1 and 3 are in this respect less sensitive to disturbances since the connection between the pipe 8 and the channel 9 is generally horizontal and preferably even slightly downwards inclined, whereby an accumulation of dirt is effectively prevented. In order to further reduce the volume of the system, the outlet pipes 8 . . . 8*n*, 8*m* are suitably construed in such a way that their diameter below the liquid surface of the level vessel 10 is smaller than their volume above said surface, as is shown with rough exaggeration with the reference numeral 8*a* in FIG. 1.

FIGS. 5*a* to 8*c* show that the collecting channel 9 is preferably construed so as to promote an accumulation of foam 21 in its upper part. Thus, the channel 9 preferably has a generally oval cross section, which in certain cases may be provided with separate spaces 22*a* for foam 21 as is shown in FIG. 5*b*. In the embodiment according to FIG. 4, the cross section of the channel is generally rectangular. The height of the channel cross section increases in the direction towards the pump 7, while the width remains essentially unchanged and the bottom of the channel is suitably horizontal. This results in a channel whose "ceiling" 22 rises in the direction towards the inlet 13 of the level vessel 10 enabling especially the foam 21 to follow this rise.

In the text above some preferred embodiments of the invention have been disclosed as examples, but it is obvious for a person skilled in the art that the invention can be varied also in many other ways within the scope of the appended claims. Thus, the arrangement may, for instance, be supplemented with suction boxes at a top former arranged above the wire or with other similar devices, from which barometric pipes lead down to the collecting channel 9 or 9*m* in a corresponding way. Moreover, the liquid which is led to the respective channel may be treated either separately alone or in combination with other liquid(s) from some other part of the process.

What is claimed is:

1. A process for collecting process water at a paper machine or the like, wherein water from several suction elements (2 . . . 2*n*, 2*m*) provided at a wire (1) is led in such a way that an essentially unbroken liquid column is maintained in the outlet pipe (8 . . . 8*n*, 8*m*) of each respective suction element (2 . . . 2*n*, 2*m*) and is made to join a common collecting vessel (9, 9*m*), wherein the liquid levels (20 . . . 20*n*) of the outlet pipes (8 . . . 8*n*, 8*m*) are regulated by regulating the liquid level (11) in at least one separate level vessel (10) towards which the water from the respective outlet pipes (8 . . . 8*n*, 8*m*) is led in at least one closed and essentially horizontal collecting channel (9, 9*m*) which is common for several outlet pipes (8 . . . 8*n*, 8*m*) in such a way that the liquid in said collecting channel (9, 9*m*), which as such leads the liquid onwards, at the same time forms the lower part of said unbroken liquid column.

2. A process according to claim 1, wherein a part of the process water is led to said level vessel, suitably so that at least a part (15) of said process water derives from another part of the process (3), and optionally comprises water from an overflow in connection with the short system of the machine.

3. A process according to claim 1 or 2, in that wherein process water collected in a save-all tray (3, 3*a*) is led to said common collecting channel (9, 9*m*), optionally so that the water in the horizontal collecting channel (9, 9*m*) is allowed to move towards the level vessel (10).

4. A process according to claim 1, wherein the pumping out from the system is controlled by regulating the liquid level (11);

in the level vessel (10), suitably so that the level during the operation of the machine is kept at a lower level than at start-up in order to maintain the balance of the system.

5. An arrangement at a paper machine for collecting process water, said arrangement comprising suction elements (2 . . . 2*n*, 2*m*) provided at a wire section or the like, said suction elements being connected by essentially vertical outlet pipes (8 . . . 8*n*, 8*m*) to at least one collecting vessel, wherein said collecting vessel is composed of at least one essentially closed collecting channel (9, 9*m*) to which said outlet pipes connect below the liquid level of the channel.

6. An arrangement according to claim 5, wherein the collecting channel (9, 9*m*) is connected to a level vessel (10) having a free liquid surface (11), suitably so that the level vessel (10) comprises an inlet (13) from the collecting channel (9, 9*m*) and a separate outlet (14) which is provided in the flow direction behind the inlet (13), optionally so that the inlet (13) and/or the outlet (14) are arranged in the lower part of the level vessel (10) below the liquid level (11) in the level vessel (10).

7. An arrangement according to claim 6, wherein in addition to said outlet pipes (8 . . . 8*n*, 8*m*) from the suction elements (2 . . . 2*n*, 2*m*), a further inlet (8*p*) from the same and/or another part of the process, suitably from the save-all tray (3, 3*a*), is connected to the horizontal collecting channel (9, 9*m*).

8. An arrangement according to claim 6 or 7, wherein a separate inlet (15) for process water from another part of the process, suitably from an overflow in connection with the short system of the machine, is connected to the level vessel (10).

9. An arrangement according to claim 6, wherein the collecting channel (9, 9*m*) at least in certain parts is constructed with a cross section having a height which is substantially larger than its width.

10. An arrangement according to claim 6, wherein the collecting channel (9, 9*m*) comprises a special portion (21) for accumulation of air and/or foam present in the liquid.

11. An arrangement according to claim 6, wherein the collecting channel is arranged substantially horizontally, suitably so that at least a part of the channel (9, 9*m*) is slightly ascending in the direction towards the level vessel (10).

12. An arrangement according to claim 6, wherein the collecting channel consists of several separate channel sections (9, 9*m*) and/or includes branchings or the like.

13. A process according to claim 2, wherein the pumping out from the system is controlled by regulating the liquid level (11);

in the level vessel (10), suitably so that the level during the operation of the machine is kept at a lower level than at start-up in order to maintain the balance of the system.

14. An arrangement according to claim 8, wherein the collecting channel (9, 9*m*) at least in certain parts is constructed with a cross section having a height which is substantially larger than its width.

15. An arrangement according to claim 14, wherein the collecting channel is arranged substantially horizontally, suitably so that at least a part of the channel (9, 9*m*) is slightly ascending in the direction towards the level vessel (10).

* * * * *